United States Patent [19]

Barrett

[11] Patent Number: 4,925,090

[45] Date of Patent: May 15, 1990

[54] NEWSPAPER DELIVERY SIGNAL

[76] Inventor: Harold R. Barrett, 5270 Coomer Rd., Pontiac, Mich. 48054

[21] Appl. No.: 348,684

[22] Filed: May 8, 1989

[51] Int. Cl.[5] ..... B65D 91/00

[52] U.S. Cl. ..... 232/34; 232/1 C

[58] Field of Search ..... 232/1 C, 34, 35, 17

[56] References Cited

U.S. PATENT DOCUMENTS

| | | | |
|---|---|---|---|
| 3,426,966 | 2/1969 | Lay | 232/35 |
| 3,750,939 | 8/1973 | Hallett | 232/35 |
| 4,492,335 | 1/1985 | Davis | 232/35 |
| 4,723,702 | 2/1988 | Martin | 232/1 C |
| 4,771,941 | 9/1988 | Bowman et al. | 232/35 |
| 4,821,953 | 4/1989 | Poloha | 232/35 |

*Primary Examiner*—Robert W. Gibson, Jr.
*Attorney, Agent, or Firm*—John J. Cantarella

[57] ABSTRACT

The present invention discloses a newspaper delivery signaling apparatus consisting primarily of a hinge having a plate attached thereto and a signaling item which drops when the plate is moved by the insertion of a newspaper into a newspaper holder and which item hangs by a cord or like item to be viewed from a distance, thereby avoiding trips to the newspaper holder in inclement weather as well as repeated trips.

4 Claims, 1 Drawing Sheet

NEWSPAPER DELIVERY SIGNAL

BACKGROUND OF THE INVENTION

1. Field of the Invention

The present invention relates generally to signaling devices for use with newspaper containers. More particularly, the present invention relates to an apparatus which attaches to a conventional newspaper holder of the tube variety which is usually mounted on a post having at least one open end.

The majority of households have newspapers delivered to their door daily, and a large number of these domiciles make use of tubular arrangements for the holding of the newspaper once it is delivered. The most obvious problem presented by the use of such a tubular housing is that the open portion of the tube is generally seated at the end of the tube that is not visible from within the domicile, thereby requiring that a person must walk to the newspaper delivery tube in order to ascertain whether or not his or her paper has been delivered. This is obviously inconvenient during inclement weather due to the cold and damp conditions that prevail, while additional inconveniences are opposed if one repeatedly walks out to an empty newspaper delivery tube. The present invention is an arrangement that would be triggered to display an indicator when a newspaper has been delivered.

2. Description of the Relevant Art

There are known several signaling devices which are used for various purposes with newspaper holders and mail boxes. These are exemplified by the following: U.S. Pat. No. 1,904,448, issued to Hampden, et al, entitled "Newspaper Box" discloses a newspaper box having a signaling device operably engaged therewith consisting of a plate and crank mechanism, whereby when a newspaper is inserted in the box an interior plate is moved which in turn turns a crank, thereby raising a signaling plate having a signaling bar attached to it, which in its operative position will rest upon the top of the receptacal; U.S. Pat. No. 2,485,707, issued to Cummins, entitled "Newspaper Trap", discloses a newspaper receiving receptacal having an open and closed position, functioning so that when it is open it is held open by a bar which is knocked into a closing position or mode when a newspaper is placed or thrown in it, the observer knows whether something is in the box by whether it is closed or open; U.S. Pat. No. 4,150,780 issued to Mapes, entitled, "Automatic Mailbox Signal", discloses a signaling flag, which is hinged to the side of a mailbox, as opposed to a newspaper box, and is aligned and mounted for pivotal movement, which is operably engaged with a metal bar attached to it which is operably engaged with the front door of a mailbox, whereby movement of the mailbox door causes the bar to move, thereby pulling the flag upward; and U.S. Pat. No. 4,066,209 entitled "Mailbox Signal Kit" , discloses a signaling device which drops, but is intended to be used in conjunction with mailboxes and is operably engaged with a mailbox door, the mechanism includes: a pivotally positioned rod running the length of the mailbox having springs thereon for returning to a predetermined position.

The aforementioned relevant art reveals devices which are used in conjunction either with mailboxes having doors thereon as opposed to newspaper holders which generally have an open end for entry of the newspaper, or they reveal newspaper signaling devices which are integral to the newspaper holder, thereby requiring a specifically designed newspaper holder or container for that device to function therewith and are substantially like mailboxes.

The present invention is designed to be used with all newspaper holders having at least one open end and is readily attachable to these as well as removable. Furthermore, it discloses a signaling device which will be visable from a relatively far distance.

3. SUMMARY OF THE INVENTION

The present invention is an apparatus which lets a person know when there is a newspaper or someother like item in their newspaper holder. This newspaper delivery signal apparatus, which is attached to a substantially tubular roadside newspaper holder having at least one open end, which is usually supported by a post sunk into the ground, usually adjacent to a roadway, sidewalk or property boundary line, for signaling when a newspaper or like item is in the newspaper holder, includes: a hinge operably engaged with the newspaper holder substantially near the open end of the newspaper holder having a portion remaining outside the newspaper holder; a nut and bolt or rivet, or like items for operably attaching the hinge to the open end of the newspaper holder; a plate attached to the hinge; the plate rests in a substantially vertical position when the newspaper holder is empty; the plate is substantially triangular having a flatened peak and a base which is curved upward toward the peak; the plate when resting in the aforementioned verticle position substantially blocks the open end of the newspaper holder; the plate rotates on the hinge to a substantially horizontal position when a newspaper is placed in said newspaper holder; a cord having a first end and a second end having the first end attached to the nut and bolt or rivet assembly used to secure the hinge to the newspaper holder; a brightly colored item is operably attached to the second end of the cord, the brightly colored item rests in the upwardly curved portion of the plate when the newspaper holder is empty, and the brightly colored item hangs from the cord when the plate is caused to rotate to a substantially horizontal position allowing the brightly colored item to be seen from a distance as it dangles beneath the newspaper holder.

It is an object of the present invention to provide a signaling device which obviates the need to go to a newspaper holder in order to ascertain whether or not a newspaper has been placed therein, particularly during inclement weather, as well as repeated trips to the newspaper holder.

4. BRIEF DESCRIPTION OF THE DRAWINGS

FIG. 1 is a plan view of the invention in use 1 in a signaling mode, i.e., when a newspaper 4 is in the newspaper holder 2.

5. DETAILED DESCRIPTION OF THE DRAWINGS AND PREFERRED EMBODIMENT

Figure 1:
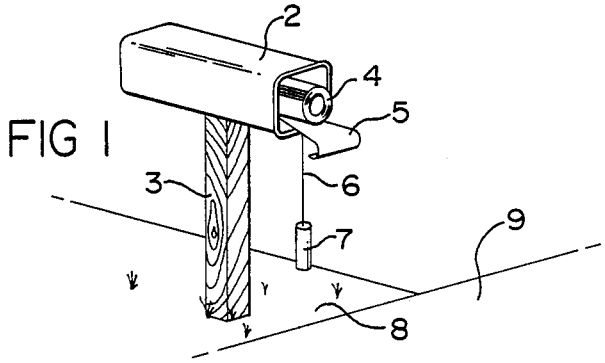

FIG. 1 shows the invention in use 1 with a newspaper 4 in the newspaper holder 2 and plate 5 depressed by newspaper 4 and the signaling item 7 dangling so as to be seen from a distance. It should be noted that while the newspaper holder 2 is not novel that it does have an open end and is mounted on post 3 which is sunk into the ground 8 usually near the roadway, sidewalk or boundary line 9. Also, cord 6 which connects signaling item 7 with the rest of the invention in use 1 is shown.

Figure 2:
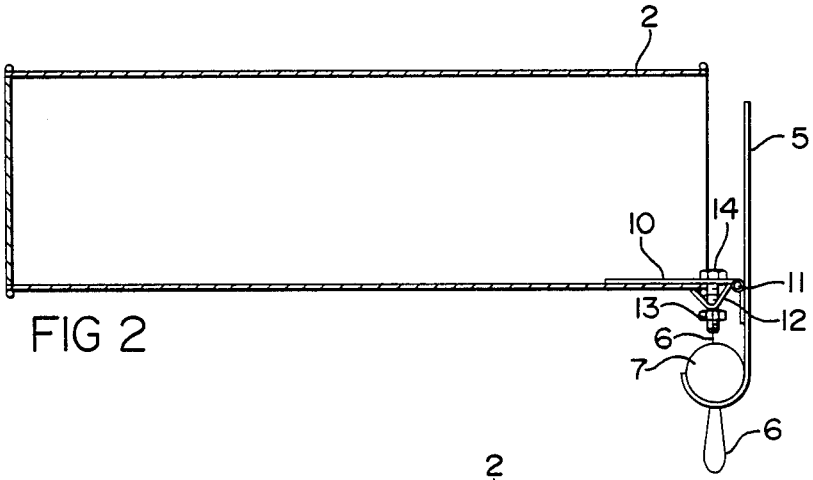
FIG. 2 is a cross-sectional view of the invention in use 1 in a non-signaling mode.

FIG. 2 is a cross-sectional view of the invention in use in a non-signaling mode, whereby plate 5 is in a substantially vertical position as it is not depressed by a newspaper 4, as shown in FIG. 1. Note, that signaling item 7 sits or rests in an upwardly curved portion of the base of plate 5 which is connected to a hinge 10 being of the variety to have a pin 11 about which plate 5 will rotate. Hinge 10 is connected to newspaper holder 2 by a threaded bolt or screw 14 and secured by bracket 12 and nut 13. Note, that cord 6 may be observed in two places one of which is a looped portion beneath the upwardly curved part of plate 5, thereby providing sufficient cord 6 for signaling item 7 to dangle from as shown from in FIGS. 1 and 3.

Figure 3:
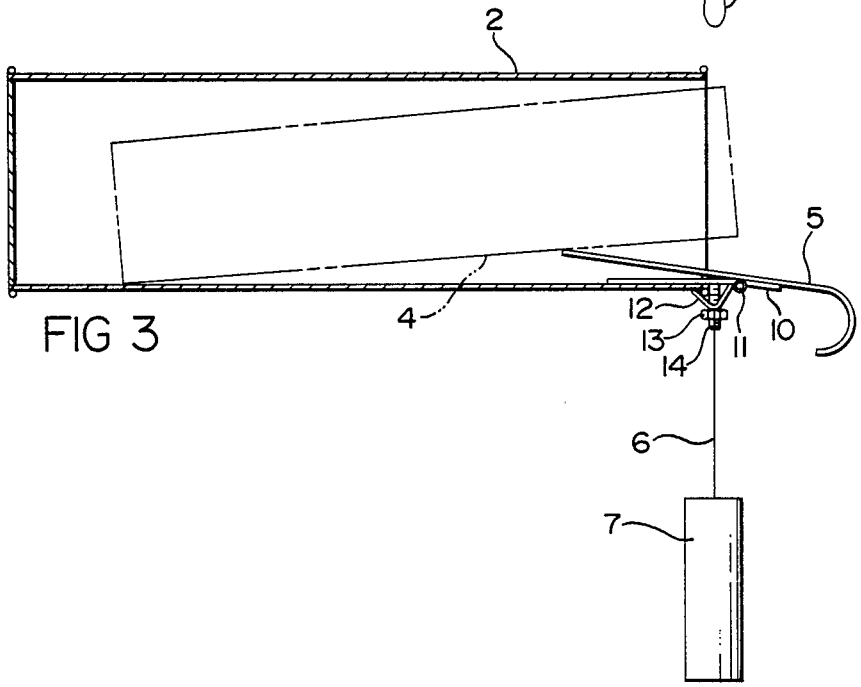
FIG. 3 is a cross-sectional view of FIG. 1.

FIG. 3 is a cross sectional view of FIG. 1 and in general does not disclose any further details of the present invention than FIGS. 1 and 2.

I claim:

1. An apparatus, which is attached to a substantially tubular roadside newspaper holder having at least one open end, which is usually supported by a post sunk into the ground, usually adjacent to a roadway, sidewalk or property boundary line, for signaling when a newspaper or like item is in the newspaper holder, comprising, in combination:

(a) a hinge operably engaged substantially near the open end of the newspaper holder having a portion remaining outside the newspaper holder;

(b) first means, for operably attaching said hinge to the open end of said newspaper holder, operably engaged with said hinge and newspaper holder;

(c) a plate operably engaged with said hinge;

(d) said plate rests in a substantially vertical position when the newspaper holder is empty;

(e) said plate is substantially triangular having a flattened peak and a base which is curved upwardly toward the peak;

(f) said plate when resting in the aforementioned vertical position substantially blocks the open end of the newspaper holder;

(g) said plate rotates on said hinge to a substantially horizontal position when a newspaper is placed in said newspaper holder;

(h) a cord having a first end and a second end is operably engaged at said first end thereof to said first means;

(i) second means, for signaling, are operably attached to the second end of said cord;

(j) said second means rest in the upwardly curved portion of said plate when the newspaper holder is empty; and (k) said second means hangs from the cord when said plate is caused to rotate to a substantially horizontal position allowing said second means to be seen from a distance.

2. The apparatus of claim 1, wherein said second means, includes:

(a) a substantially cylindrical shaped item configured to fall out of said upwardly curved portion of said plate when it is in a horizontal position.

3. The apparatus of claim 2, wherein said first means, includes:

(a) a bolt having threads thereon operably engaged with said hinge and newspaper holder;

(b) and a nut operably engaged with the threads of said bolt.

4. The apparatus of claim 2 wherein, said first means includes a rivet operably engaged with said hinge and newspaper holder.

* * * * *